US005494723A

United States Patent [19]

Erren et al.

[11] Patent Number: 5,494,723

[45] Date of Patent: Feb. 27, 1996

[54] TUFTING CARPET

[75] Inventors: Karl-Heinz Erren, Aukrug-Homfeld; Regina Grewe, Neumunster; Robert Heidhues, Aukrug-Bünzen; Frank Höppner, Neumunster, all of Germany

[73] Assignee: Norddeutsche Faserwerke GmbH, Germany

[21] Appl. No.: 194,730

[22] Filed: Feb. 10, 1994

Related U.S. Application Data

[63] Continuation of Ser. No. 864,446, Apr. 6, 1992, abandoned.

[30] Foreign Application Priority Data

Apr. 9, 1991 [DE] Germany ..... 41 11 455.8

[51] Int. Cl.[6] ..... B32B 3/02

[52] U.S. Cl. ..... 428/95; 428/96; 428/97; 156/72

[58] Field of Search ..... 428/95, 96, 97; 156/72

[56] References Cited

U.S. PATENT DOCUMENTS

| | | | |
|---|---|---|---|
| 2,983,028 | 5/1961 | Cole | 428/85 |
| 3,110,905 | 11/1963 | Rhodes | 428/97 |
| 3,348,992 | 10/1967 | Cochran, II | 428/97 |
| 3,348,993 | 10/1967 | Sissons | 428/97 |
| 3,505,097 | 4/1970 | Ratcliffe | 428/96 |
| 3,717,524 | 2/1973 | Culp et al. | 156/72 |
| 3,732,708 | 5/1973 | Troy | 66/191 |
| 3,779,857 | 12/1973 | Hadgraft et al. | 428/96 |
| 4,009,310 | 2/1977 | Scobbo | 428/95 |
| 4,123,577 | 10/1978 | Port et al. | 428/95 |
| 4,576,665 | 3/1986 | Machell | 156/72 |
| 4,656,073 | 4/1987 | Harris | 428/95 |
| 4,844,765 | 7/1989 | Reith | 156/306.6 |
| 4,871,604 | 10/1989 | Hackler | 428/95 |
| 5,240,530 | 8/1993 | Fink | 156/72 |
| 5,370,757 | 12/1994 | Corbin et al. | 156/72 |

FOREIGN PATENT DOCUMENTS

| | | |
|---|---|---|
| 625605A1 | of 1994 | European Pat. Off. . |
| 4140580 | 12/1910 | Germany . |

*Primary Examiner*—George F. Lesmes
*Assistant Examiner*—Terrel Morris
*Attorney, Agent, or Firm*—Merchant, Gould, Smith, Edell, Welter & Schmidt

[57] ABSTRACT

A tufting carpet is described which comprises a tufting base, a pile material and a carpet back and essentially consists exclusively of polyamide 6. Through the use of a chemically uniform material in all components of the tufting carpet, the latter can be recycled as a whole for recovery of the monomeric starting material without the need for separation into the individual components, which has hitherto hampered the recycling of tufting carpets and led to major waste disposal problems.

16 Claims, No Drawings

TUFTING CARPET

This is a continuation of application Ser. No. 07/864,446, filed on Apr. 6, 1992, now abandoned.

FIELD OF THE INVENTION

The invention relates to a tufting carpet and to its use as a floor and wall covering.

BACKGROUND OF THE INVENTION

Carpets are tufted, woven, knotted and needled from manmade fibres, wool, haircord, silk and cotton. Tufting is the dominant production technique for factory-manufactured carpets, the use of manmade fibres and in particular polyamide (mainly polyamide 6.6) filament yarns and staple fibre yarns predominating. The factory-finished tufting carpet, which can be used as both a floor covering and a wall covering, offers not only comfort but also considerable advantages in terms of insulation, and thereby aids the heat balance in buildings.

The tufting carpet structures usual today predominantly consist of three components, namely the tufting base, the pile material and the carpet back. Various materials, which differ basically from one another in chemical terms and cannot be regenerated with one another, e.g. polypropylene, polyamide, polyurethane, polyvinyl chloride and jute, are used for these components. Combinations of polypropylene as base woven fabric, polyamide as pile material and polyurethane as back coating predominate.

The tufting base is a woven fabric which predominantly comprises polypropylene or a spun non-woven made from polyester or polypropylene. Jute woven fabrics are used more rarely.

The pile material consists predominantly of staple fibres made from polyamide, secondarily spun and then subsequently tufted, or of polyamides which have been extruded in a single- or multi-step process to produce a continuous filament yarn, stretched and texturized (BCF yarns=bulked continuous filament).

The carpet back performs several functions. A rubber or SB latex pre-coating is added to the tufted carpet to secure the tufting loops. In the case of tufting carpets for objects, a second back predominantly comprising polyester woven fabric is frequently glued on and the carpet laid thus. For use in the residential sector, partly filled foams based on latex or polyurethane are usually added to increase comfort.

The tufting carpets structured in the manner described pose a major refuse- or waste-disposal problem once their use is finished, as they occur in large quantities (large volume and large weight) and practically disintegrate not at all, or only very slowly. Separation into the individual components and re-use of these components is also extremely difficult or virtually impossible and has thus been disregarded to date already on purely economic grounds. In view of the ever-increasing waste-disposal problems, there is thus a pressing need for tufting carpets which can be easily disposed of or re-utilized after use.

OBJECT OF THE INVENTION

Therefore it is an object of the invention to provide a tufting carpet which can be easily disposed of or is preferably reutilizable (recyclable) after use.

SUMMARY OF THE INVENTION

The invention is directed to a tufting carpet which comprises a tufting base, a pile material and a carpet back and is characterized in that it essentially consists exclusively of polyamide 6.

A further subject of the invention is the use of the carpet according to the invention as a floor and wall covering.

Preferred embodiments and advantages of the invention will become apparent from the following detailed description of the invention and the subclaims.

DETAILED DESCRIPTION OF THE INVENTION

It was surprisingly found that the manufacture of tufting carpets from essentially a single chemically uniform material (apart from usual auxiliaries such as dyestuffs, antistatic agents etc.) is possible if the material for the various components is carefully selected with regard to the necessary properties. Through the use of a chemically uniform material in all components of the tufting carpet it is no longer necessary, when working-up and re-utilizing used carpet, to separate the components and their constituents from one another. Rather, the carpet can be recycled as a whole to recover the monomeric starting material, since polyamide 6 can be recycled into the monomeric starting product caprolactam by simple depolymerization.

In addition the invention provides the advantage that the use of a chemically uniform material in all components of the tufting carpet provides equal dyeability of the pile and base and increased light stability in comparison to the conventional use of polypropylene as tufting base. Furthermore, the tufting carpet according to the invention provides higher elasticity, allows the application of higher dying and finishing temperatures, and thus produces an overall positive economic result.

The tufting base of the tufting carpet according to the invention comprises a woven fabric, knitted fabric, non-woven or a stretched film made from polyamide 6. If a textile fabric manufactured by means of warp-knitting—warp-knitted fabric—is used, the knitwear should mainly be produced with the following pattern layout:

| | |
|---|---|
| Guide bar 1 Chain Link Reading: | 102–454 (velvet stitch) |
| Guide bar 2 Chain Link Reading: | 100–011 (pillar stitch) |
| Stitches/cm | 20 |
| Pitch (needles/inch) | E 28 |

Knitwear in this version gives a stable product web without rolling selvedges and is firm in itself given adequate longitudinal and lateral extension. Because of the high racking in guide bar 1, the lay chosen prevents severance of the total structure in the event of any damage to filaments from the tufting needles.

The knitwear leads to an extensible tufting carpet which can be stabilized by the following back securing but still has the necessary extensibility of 3 to 7% for tensioning. The knitwear also displays high displacement strength, so that problems, e.g. tearing of the carpet at the needle strip caused by low displacement strength, are avoided.

The yarns used for the knitwear, predominantly filament yarns, lie in the denier range from 20 dtex to 200 dtex (1 dtex=0,9 den) Yarns with a denier of 44 dtex or 67 dtex have proved particularly suitable. The filament yarns display a shrinkage of ca. 14%, which can be triggered by heating (fixing). If the pile is tufted on before the fixing, triggering the shrinkage results in a compression of the surface and thus an increase in the quality of the tufting carpet. On the other hand, one can tuft to advantage on a coarser machine pitch and use the triggered shrinkage to achieve a product surface as from a tufting machine with a finer pitch. For example, a tufting product (1/10" pitch, 8 mm pile, 45 stitches/cm) shrinks, using the warp-knitted product described above as carrier material, by 25% from 1270 g/m$^2$ to 1600 g/m$^2$. If such shrinkage effects are not wanted, totally fixed and thus stabilized knitwear of the same structure can be used as tufting base.

With a woven product as tufting base, plain weave is preferred in order to achieve uniform stability in warp and weft. The thread density in warp and weft depends on the yarn thickness used. Chiefly suitable are yarns in the fineness range from 200 to 4000 dtex. Typical thread densities for a yarn thickness of 300 dtex are 8 to 14 threads/cm in the warp, and 5 to 10 threads/cm in the weft for a yarn thickness of 1100 dtex. The displacement strength and diagonal stability of the coarse woven fabrics can be improved by additionally applying a layer of a non-woven. In the case of the woven product, extensibility is at a low level because of the marked power absorption caused by the weave, so that the lower extension range of 3% must be chosen for tensioning.

However, carpets with greater extension can be produced here as well by means of texturized yarns, i.e. polyamide yarns with higher elasticity, and can be finished to measure to meet the needs of the use.

A non-woven as carpet base exhibits a uniform strength in all directions with an extensibility which can be adjusted through the securing, but its strength is less than that of other base products. Particularly suitable are non-wovens with a weight of 90 to 200 g/m$^2$ and preferably 110 to 150 g/m$^2$ and a strength in longitudinal direction of 130 to 170 N/5 cm and preferably 140 to 160N/5 cm and a strength in transverse direction 100 to 150N/5 cm and preferably 110 to 140N/5 cm.

Yarn spun secondarily in the usual way from staple fibres, continuous stretch-texturized filament yarn or another yarn manufactured in whatever way exclusively from polyamide 6 is used as pile or tuft material. The yarn, which lies chiefly in the denier range from 800 dtex to 4000 dtex, can be used texturized normally or additionally fixed or twisted and fixed.

The pile tufting loops are secured by gluing with a polyamide film or with polyamide melt adhesive powder or a partially solvated polyamide melt.

In order to secure the tufting loops, the polyamide film or polyamide powder must be heated until it flows or a partially solvated polyamide melt applied while liquid in order to secure the tufting loops satisfactorily. A copolyamide characterized by a reduced melting point is used to advantage, but the highest possible proportion of polyamide 6 is chosen, especially copolyamides with a polyamide 6 content of at least 80 wt.-% and preferably at least 90 wt.-%. The auxiliary component introduced to the least extent is of subordinate significance relative to the total weight of the material used and therefore poses no problems for recycling through depolymerization and the associated attempt to recover the starting component, caprolactam. Copolyamides suitable for this purpose are standard commercial melt adhesives available both in film form and in powder form.

The degree of securing can be controlled through both the type of copolymer and the thickness of the film or the amount of the powder in order to reflect application and use. Deposits of 30 to 90 g/m$^2$ and preferably 40 to 70 g/m$^2$ are typical. At the same time, the extensibility of the carpet for tensioning, especially when using knitwear as carpet base, is pre-set by the degree of securing.

When the tufting loops are being secured, a textile surface made from polyamide 6, e.g. a woven product, a non-woven or knitwear, can be simultaneously applied as a second back for additional stabilization of the carpet. The carpet structure according to the invention is laid with or without a separate insulation layer without gluing by tensioning over needle strips. The insulation layer itself can then be taken up again after use has ended and re-utilized separately. In this way the laid carpet remains recyclable.

Practice of the invention will be become further apparent from the following non-limiting examples.

EXAMPLE 1

Example of a structure of a textile floor covering made by the tufting process:

| | | |
|---|---|---|
| Tufting base: | Warp-knitted product made from polyamide 6 | |
| | Machine fineness: (needles/inch) | 28 E |
| | Guide bar 1: | Material dtex 44 |
| | Chain Link Reading: | 102–454 (velvet stitch) |
| | Guide bar 2: | Material dtex 44 |
| | Chain Link Reading: | 100-011 (pillar stitch) |
| | Stitches/cm: | 20 |
| | Weight g/m$^2$: | 90 |
| Pile: | Polyamide 6 carpet yarn | |
| | Type: | dtex 1250 f 68 × 2, 215 T/m, S-wire fixed, antistatic |
| Tufts: | Machine pitch: | 1/10" |
| | Pile height (mm): | 8 |
| | No. of stitches/10 cm, raw: | 46 |
| | Pile input weight, raw (g/m$^2$): | 1270 |
| | Pile input weight after colouring, uncut (g/m$^2$): | 1604 |
| Securing: | Copolyamide film (optical melting point DIN 53376 B 110 to 115 degrees C.) - weight 40 g/m$^2$. | |
| | Securing: | 115–122 degrees C. |

EXAMPLE 2

Example of a structure of a textile floor covering made by the tufting process with a second back:

| | |
|---|---|
| Tufting base: | analogous to Example 1 |
| Pile: | analogous to Example 1 |
| Tufts: | analogous to Example 1 |
| Securing: | Copolyamide film (melting range as Example 1) - 40 g/m$^2$ - and warp-knitted product analogous to tufting base are laminated onto the tuftingstructure (temperature 115–122 degrees C.) |

We claim:

1. A tufting carpet comprising:

a tufting base having a first and second side;

a pile material having pile tufting loops, the pile material secured to the first side of the tufting base; and means for securing the pile tufting loops to the tufting base, said means selected from the group consisting of a film, a melt adhesive powder or a partially solvated melt wherein the means for securing is attached to the second side of the tufting base, wherein each element of the carpet consists essentially of nylon-6 or a copolyamide with a high polyamide 6 content, whereby said tufting carpet is recyclable.

2. The tufting carpet of claim 1, wherein the tufting base is knitwear.

3. The tufting carpet of claim 2, wherein the tufting base consists of yarns in the denier range from 20 dtex to 200 dtex.

4. The tufting carpet of claim 2, wherein the tufting base consists of filament yarn.

5. The tufting carpet of claim 3, wherein the tufting base consists of filament yarn.

6. The tufting carpet of claim 2, wherein the tufting base is knitwear produced following lay:

| | |
|---|---|
| guide bar 1 (velvet) | 102–454 |
| guide bar 2 (thread) | 100–011 |
| Stitches/cm | 20 |
| Pitch | E 28] |

on a warp knitting machine gauge E28 (28 needles/inch), 20 stitches/cm, with guide bars having the following chain link readings,

| | |
|---|---|
| guide bar 1 | 102–454 velvet stitch, |
| guide bar 2 | 100–011 pillar stitch. |

7. The tufting carpet of claim 3, wherein the tufting base is knitwear produced on a warp knitting machine gauge E28 (28 needles/inch), 20 stitches/cm, with guide bars having the following chain link readings,

| | |
|---|---|
| guide bar 1 | 102–454 velvet stitch, |
| guide bar 2 | 100–011 pillar stitch. |

8. The tufting carpet of claim 4, wherein the tufting base is knitwear produced on a warp knitting machine gauge E28 (28 needles/inch), 20 stitches/cm, with guide bars having the following chain link readings,

| | |
|---|---|
| guide bar 1 | 102–454 velvet stitch, |
| guide bar 2 | 100–011 pillar stitch. |

9. The tufting carpet of claim 1, wherein the tufting base is a woven product.

10. The tufting carpet of claim 9, wherein the tufting base consists of yarns in the fineness range from 200 to 4000 dtex and the weave is plain weave.

11. The tufting carpet of claim 1, wherein the tufting base is a non-woven.

12. The tufting carpet of claim 1, wherein the means for securing consists of a film.

13. The tufting carpet of claim 2, wherein the means for securing consists of a melt adhesive powder.

14. The tufting carpet of claim 9, wherein the means for securing consists of a partially solvated melt.

15. The tufting carpet of claim 1, wherein the tufting base and pile material consist exclusively of polyamide-6 and the means for securing consists of a copolyamide with a high polyamide 6 content.

16. The tufting carpet of claim 1, further comprising a second carpet back secured to the carpet back.

* * * * *